US010221042B2

(12) United States Patent
Haapaniemi et al.

(10) Patent No.: US 10,221,042 B2
(45) Date of Patent: Mar. 5, 2019

(54) ELEVATOR PROVIDED WITH A SAFETY DEVICE ARRANGEMENT

(71) Applicants: Markku Haapaniemi, Helsinki (FI); Matti Rasanen, Hyvinkaa (FI); Markku Haivala, Hyvinkaa (FI); Janne Mikkonen, Jarvenpaa (FI); Esko Aulanko, Kerava (FI); Ari Kattainen, Hyvinkaa (FI)

(72) Inventors: Markku Haapaniemi, Helsinki (FI); Matti Rasanen, Hyvinkaa (FI); Markku Haivala, Hyvinkaa (FI); Janne Mikkonen, Jarvenpaa (FI); Esko Aulanko, Kerava (FI); Ari Kattainen, Hyvinkaa (FI)

(73) Assignee: KONE CORPORATION, Helsinki (FI)

( * ) Notice: Subject to any disclaimer, the term of this patent is extended or adjusted under 35 U.S.C. 154(b) by 315 days.

(21) Appl. No.: 15/211,325

(22) Filed: Jul. 15, 2016

(65) Prior Publication Data

US 2016/0325965 A1 Nov. 10, 2016

Related U.S. Application Data

(63) Continuation of application No. PCT/FI2014/050974, filed on Dec. 10, 2014.

(30) Foreign Application Priority Data

Jan. 21, 2014 (FI) ..... 20145057

(51) Int. Cl.

| | |
|---|---|
| ***B66B 5/00*** | (2006.01) |
| ***B66B 5/22*** | (2006.01) |
| *B66B 5/04* | (2006.01) |

(52) U.S. Cl.

CPC ..... *B66B 5/005* (2013.01); *B66B 5/0062* (2013.01); *B66B 5/22* (2013.01); *B66B 5/044* (2013.01)

(58) Field of Classification Search

CPC ..... B66B 5/005; B66B 5/0062; B66B 5/22

See application file for complete search history.

(56) References Cited

U.S. PATENT DOCUMENTS

| | | | |
|---|---|---|---|
| 1,143,017 | A | 6/1915 | Andrews, Jr. |
| 1,314,228 | A | 8/1919 | Turgeon |

(Continued)

FOREIGN PATENT DOCUMENTS

| | | | |
|---|---|---|---|
| CN | 1942385 | A | 4/2007 |
| CN | 101472824 | A | 7/2009 |

(Continued)

OTHER PUBLICATIONS

International Search Report PCT/ISA/210 for International Application No. PCT/FI2014/050974 dated Apr. 28, 2015.

(Continued)

*Primary Examiner* — Michael A Riegelman

(74) *Attorney, Agent, or Firm* — Harness, Dickey & Pierce, P.L.C.

(57) ABSTRACT

The object of the invention is an elevator provided with a safety device arrangement, which elevator comprises at least an elevator car traveling along guide rails and a safety brake device for stopping unintended movement of the elevator car. The safety device arrangement comprises a tuning apparatus disposed on the elevator car for detecting a presence on the roof of the elevator car.

20 Claims, 5 Drawing Sheets

(56) References Cited

U.S. PATENT DOCUMENTS

Figure 1:
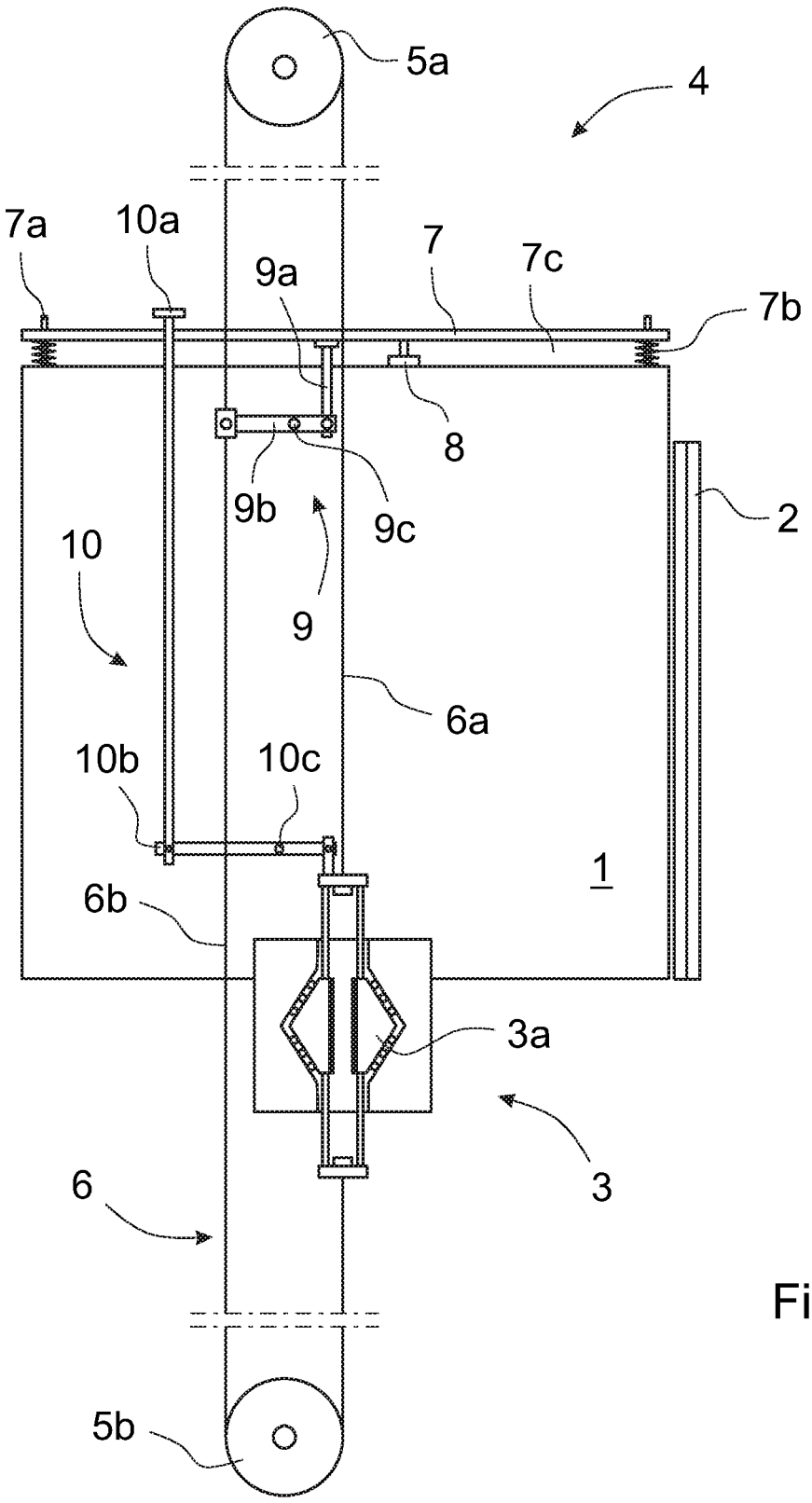

| | | | | |
|---|---|---|---|---|
| 1,662,692 | A * | 3/1928 | Adsero | B66B 5/22 187/372 |
| 6,318,507 | B1 * | 11/2001 | Jin | B66B 5/04 187/351 |
| 7,523,809 | B2 | 4/2009 | Monzon-Simon et al. | |
| 8,028,808 | B2 | 10/2011 | Gonzalez Rodil et al. | |
| 8,708,106 | B2 * | 4/2014 | Rasanen | B66B 5/005 187/302 |
| 8,770,349 | B2 | 7/2014 | Madar | |
| 2008/0245619 | A1 | 10/2008 | Monzon-Simon et al. | |
| 2009/0183955 | A1 * | 7/2009 | Gonzalez Rodil | B66B 5/0081 187/404 |
| 2011/0155510 | A1 * | 6/2011 | Lindberg | B66B 5/005 187/314 |
| 2011/0240413 | A1 | 10/2011 | Madar | |
| 2013/0043098 | A1 * | 2/2013 | Baltisser | B66B 5/0056 187/401 |
| 2015/0225207 | A1 * | 8/2015 | Minatta | B66B 19/00 187/377 |
| 2018/0022579 | A1 * | 1/2018 | Haapaniemi | B66B 7/10 187/412 |
| 2018/0244494 | A1 * | 8/2018 | Talonen | B66B 5/005 |

FOREIGN PATENT DOCUMENTS

| | | | |
|---|---|---|---|
| CN | 202785140 | U | 3/2013 |
| CN | 202808113 | U | 3/2013 |
| EP | 2070859 | A1 | 6/2009 |
| GB | 2379654 | A | 3/2003 |
| JP | 2008239318 | A | 10/2008 |
| WO | WO-2005105645 | A1 | 11/2005 |
| WO | WO-2008002300 | A1 | 1/2008 |
| WO | WO-2008081074 | A1 | 7/2008 |
| WO | WO-2010122211 | A1 | 10/2010 |
| WO | WO-2011030325 | A1 | 3/2011 |

OTHER PUBLICATIONS

Finnish Search Report #20145057 dated Sep. 26, 2014.

Written Opinion of the International Searching Authority PCT/ISA/237 for International Application No. PCT/F12014/050974 dated Apr. 28, 2015.

Office Action for Chinese Application No. 201480073701.6 dated May 25, 2017(with translation).

* cited by examiner

ELEVATOR PROVIDED WITH A SAFETY DEVICE ARRANGEMENT

This application is a continuation of PCT International Application No. PCT/FI2014/050974 which has an International filing date of Dec. 10, 2014, and which claims priority to Finnish patent application number 20145057 filed Jan. 21, 2014, the entire contents of both of which are incorporated herein by reference.

The object of the invention is an elevator, as defined in the preamble of claim 1, said elevator being provided with a safety device arrangement, more particularly for working on the roof of the elevator car.

Situations are encountered during the operation of an elevator when someone must go onto the roof of the elevator car, either for inspections, servicing or e.g. for some other repair. If the height of the top clearance of the elevator hoistway is shallow, sufficient safety spaces, which prevent personal injuries occurring, for personnel working on the roof of the elevator car cannot be guaranteed without special procedures.

In this case movement of the elevator car and of the counterweight must be prevented in some other way than by means of the operating brakes of the elevator. It is known that this can be done by locking the elevator car and/or the counterweight into their positions on the guide rail e.g. by means of a safety gear, a latch or wedges. This is, however, awkward, laborious and time-consuming, and necessitates working in the elevator hoistway. Another known solution is to fix a rope clamp to the hoisting roping, by means of which rope clamp the hoisting roping is bound fast to e.g. the overhead beam of the hoistway. This is also, however, an awkward and time-consuming solution and requires special tools.

Many other different solutions have also been made according to prior art for achieving adequate safety spaces in the top part of an elevator hoistway. For example, known in the art are safety solutions in which one or more turnable buffers are disposed below the counterweight, which buffer(s) is/are lifted upright before going onto the roof of the elevator car to work. The length of the buffers is such that the movement of the counterweight, and at the same time the movement of the elevator car, stops before the elevator car rises too high with respect to the roof of the elevator hoistway. One problem, among others, in these solutions is, however, that the hoistway space might have been dimensioned so precisely that there is no proper space in the bottom part of the elevator hoistway for turnable buffers. Another problem is that the aforementioned buffers ensuring the top safety space are in the bottom part of the elevator hoistway, i.e. right at the other end of the elevator hoistway. In this case installing the buffers into the safe position takes extra time and it might also happen that for this reason they are not visited beforehand to install them into the safe position, in which case the safety of people working on the roof of the elevator car is not ensured.

If, on the other hand, the turnable safety buffers are in the top part of the elevator hoistway, that also can cause situations in which a person could not or did not remember to go and turn the buffers into the safe position before working on the roof of the elevator car is started. This situation also exposes people working on the roof of the elevator car to danger.

In addition to the aforementioned, the safety solutions are often based on electrical supervisions installed in the doors of the hoistway, which supervisions must be switched to the safe position before going onto the roof of the elevator car.

Turning the buffers into the safe position and activation of the electrical supervision circuits are often such a complex combination that, particularly e.g. with small tasks, they might be left undone owing to their complexity and for saving the time used. In addition, electrical supervision systems are susceptible to failure.

The purpose of this invention is to eliminate the aforementioned drawbacks and to achieve an elevator provided with a safety device arrangement, wherein the safety device arrangement is easy-to-use and time-saving as well as operationally reliable, and wherein the locking preventing movement of the elevator car is implemented automatically without separate complex and time-consuming procedures. The elevator, according to the invention, provided with a safety device arrangement is characterized by what is disclosed in the characterization part of claim 1. Other embodiments of the invention are characterized by what is disclosed in the other claims.

Advantageous and dependable ways for bringing about a safe space above the elevator car are achieved with the invention. Preferably the safe space to be formed by means of the invention is applicable to and sufficient for performing servicing tasks and other procedures to be carried out from the roof of the elevator car.

Preferably the invention is expressed as an elevator provided with a safety device arrangement, which elevator comprises at least an elevator car traveling along guide rails and a safety brake device for stopping unintended movement of the elevator car, which safety device arrangement comprises a tuning apparatus disposed on the elevator car for detecting a presence on the roof of the elevator car.

Some inventive embodiments are also discussed in the descriptive section of the present application. The inventive content of the application can also be defined differently than in the claims presented below. The inventive content may also consist of several separate inventions, especially if the invention is considered in the light of expressions or implicit sub-tasks or from the point of view of advantages or categories of advantages achieved. In this case, some of the attributes contained in the claims below may be superfluous from the point of view of separate inventive concepts. Likewise the different details presented in connection with each embodiment can also be applied in other embodiments. In addition it can be stated that at least some of the subordinate claims can in at least some situations be deemed to be inventive in their own right.

The invention can be implemented e.g. as an elevator in which is a safety device arrangement bringing about the operation of a safety brake device of the elevator car for stopping unintended movement of the elevator car in such a way that a tuning apparatus disposed on the elevator car detects a presence on the roof of the elevator car and, if necessary, causes operation of a safety device.

In one embodiment of the invention the tuning apparatus comprises at least a tread base that is on the roof of an elevator car and that gives under a weight, the giving movement under which weight causes operation of a safety device. For example, the tuning apparatus can comprise at least tread base arranged movably, preferably movably in the vertical direction, on top of the roof of the elevator car, a detector of movement of the tread base and a transmission means for activating a safety brake device into a standby state or into a braking state as a consequence of movement of the tread base. Preferably the tread base is adapted to move on vertical guide rails above the roof of the elevator car and to rest supported on spring means, as well as to cover essentially the whole of the roof of the elevator car.

The invention enables a safe way of fabricating an elevator that has a shallow top clearance; at it most advantageous the top clearance can even be minimized to the minimum, or close to the minimum, required by the trajectories of the elevator. Thus when the elevator car is in its uppermost possible position on its trajectory, the hoistway space above the elevator car is small and the height of the elevator hoistway can easily be fitted inside the building. Preferably the safety device to be used in the invention is adapted to an elevator solution that in itself shortens the top hoistway space needed on the trajectory of the elevator car. Most preferably solutions can be achieved in this way wherein the roof of the elevator hoistway is at most 2400 mm higher than the floor of the topmost floor level of the elevator, in which case when fabricating the roof of the building the room height of the topmost floor level determines the structures needed and the height of the elevator hoistway does not affect the method of building the roof. The suspension of the elevator car from its bottom part, e.g. using a 2:1 underslung suspension, easily eliminates the need for suspension parts above the elevator car. In this type of suspension from the bottom part of the elevator car, the passage of the hoisting ropes is arranged to the sides of the elevator car and the supporting of the hoisting ropes, in relation to the elevator hoistway, in the top part of the elevator hoistway is arranged, e.g. by means of diverting pulleys, below the roof of the elevator hoistway. Likewise the top wheel of the rope loop of the overspeed governor is supported in its position below the roof of the elevator hoistway. The suspending hoisting ropes can be steel ropes or ropes, e.g. flat belts. One advantage of the solution according to the invention is that by means of it movement of the elevator car can be effectively, dependably and safely prevented. Another advantage is that the solution is very easy and quick to use, and does not necessitate awkward working in the hoistway nor preliminary procedures in the top end or bottom end of the elevator hoistway. Another advantage is the improvement in safety compared to conventional solutions, because the locking of unintended movement of the elevator car switches on automatically when stepping onto the roof of the elevator car. In this case situations cannot arise where switching the safety circuit on would be forgotten, or where a person could not be bothered to switch it on because of its complexity, e.g. for a short job to be performed on the roof. Another advantage is that the solution according to the invention also enables types of elevator applications that, for some reason, lack natural top clearances. Another advantage is that the apparatus comprised in the arrangement takes little space. A further advantage is also that the solution is inexpensive and simple to implement.

Figure 2:
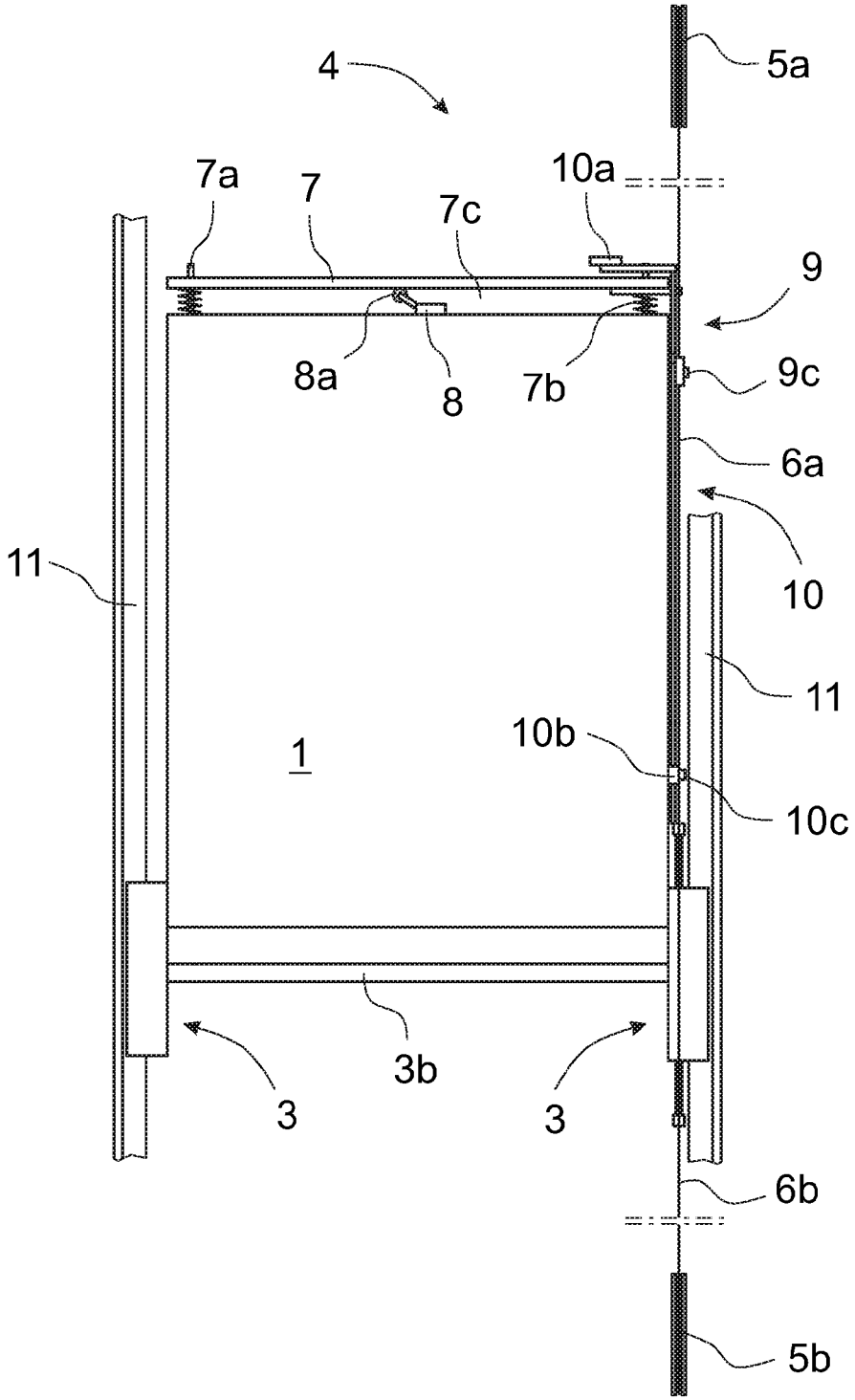
Figure 3:
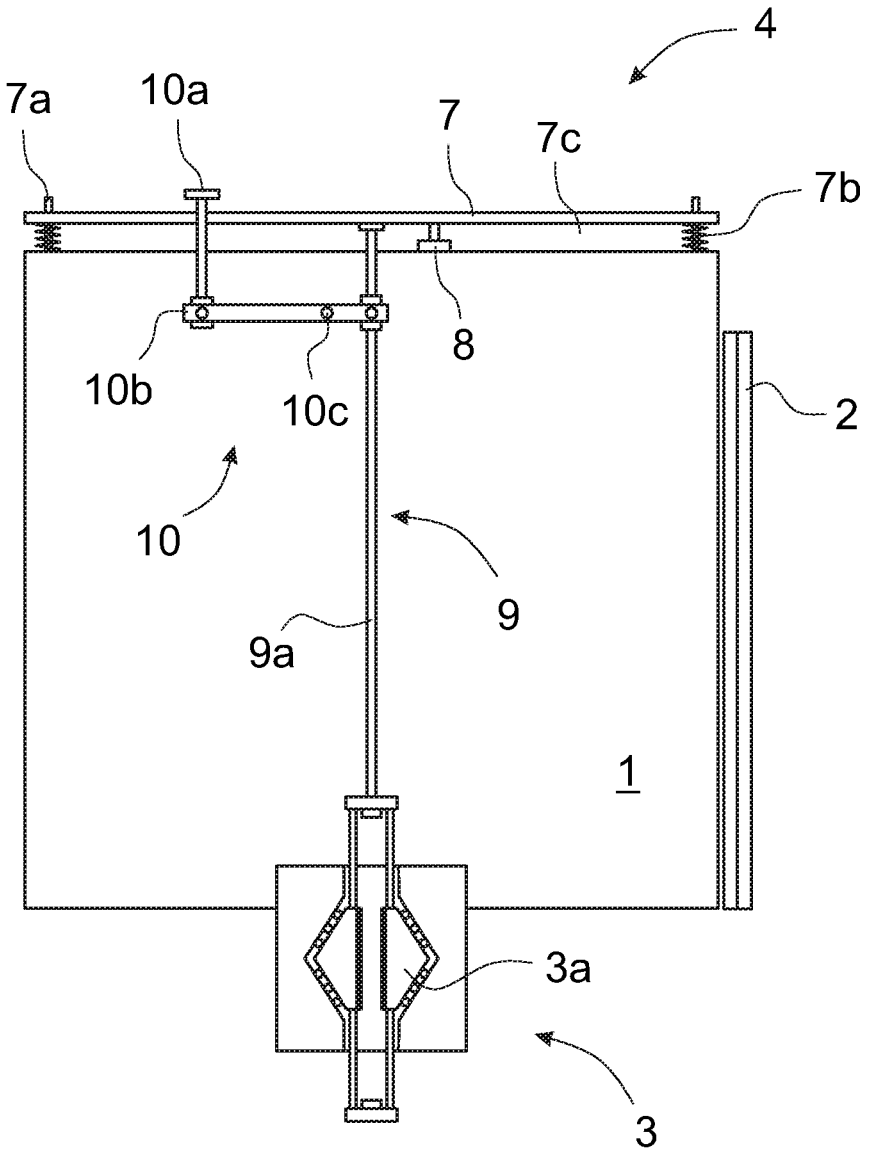
Figure 4:
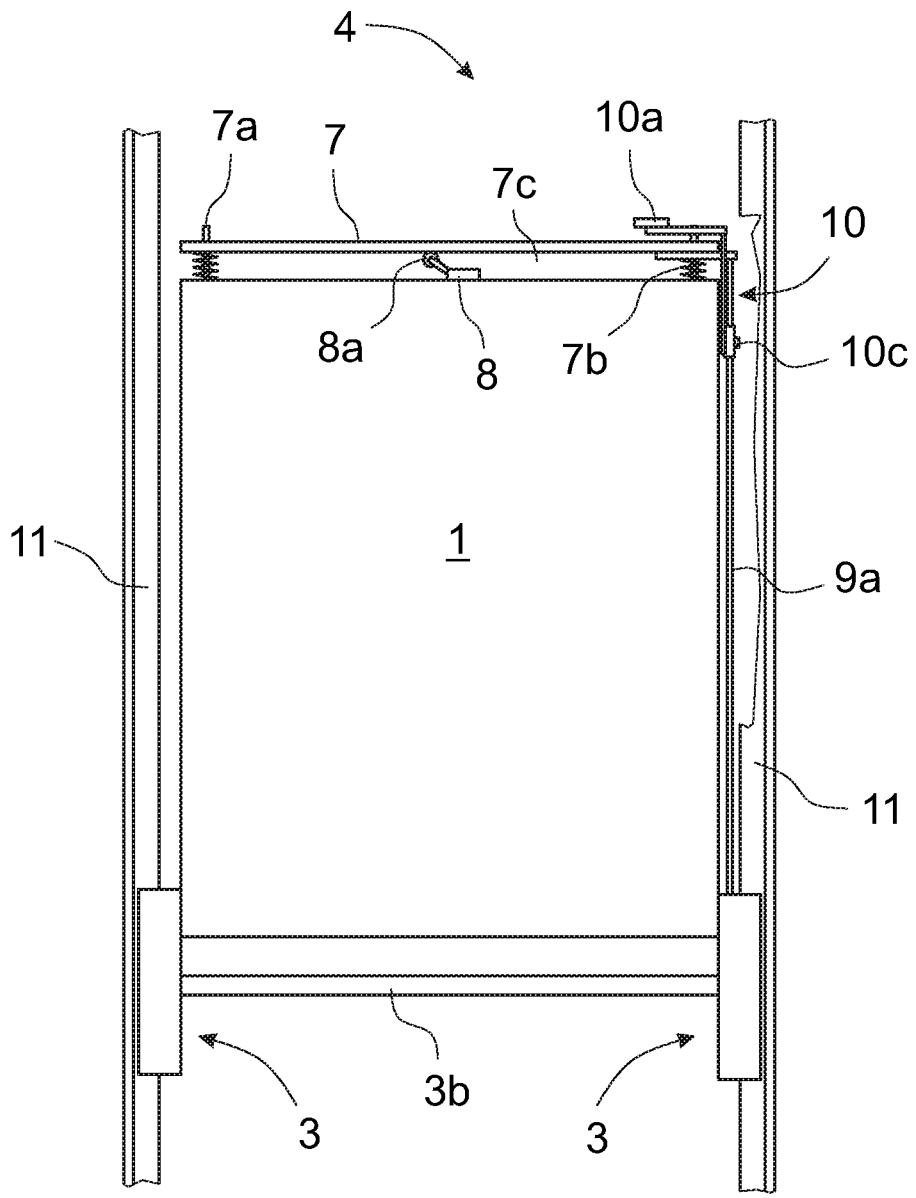
Figure 5:
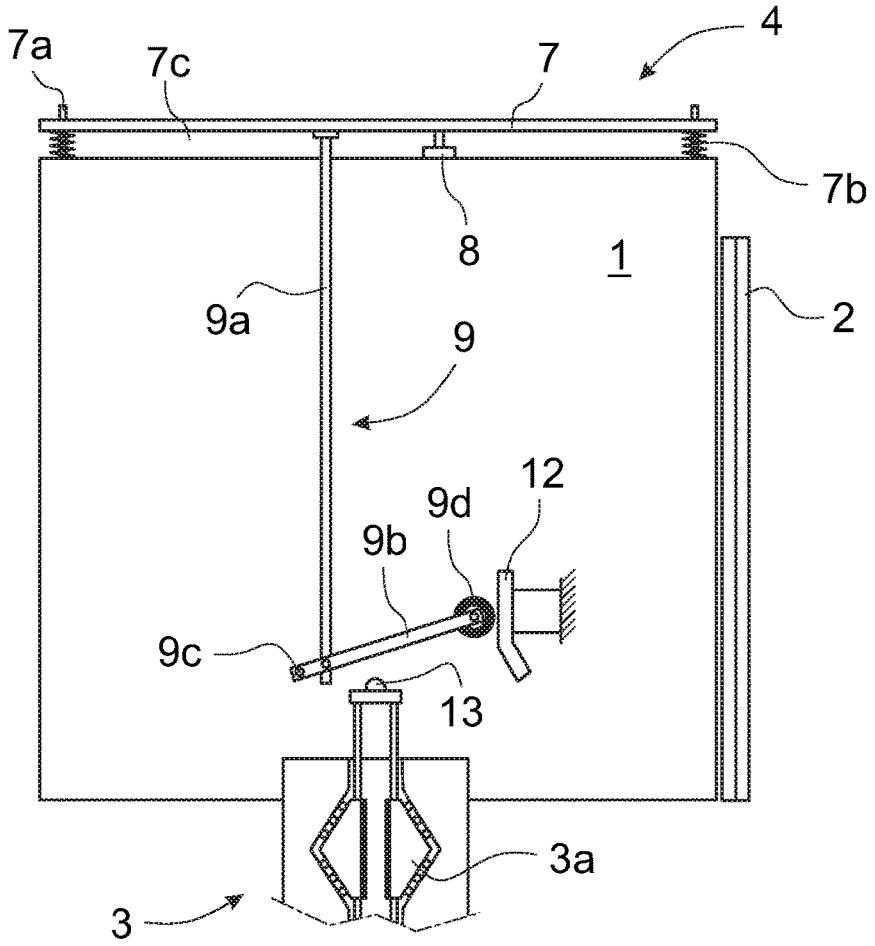
Figure 6:
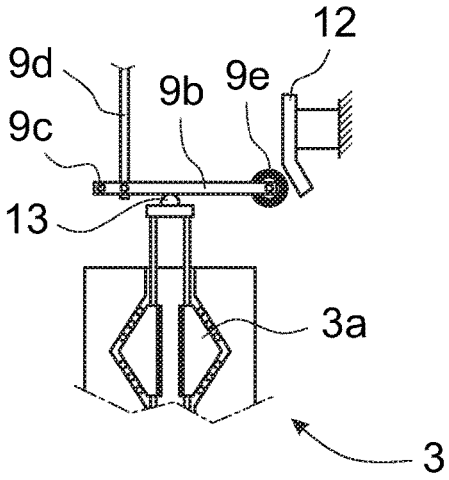
Figure 7:
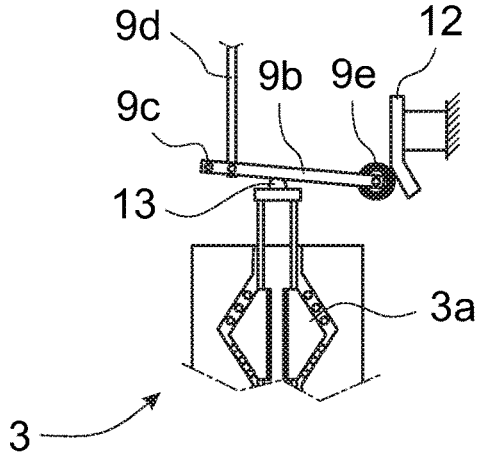

In the following, the invention will be described in detail by the aid of some examples of its embodiment with reference to the attached diagrammatic and simplified drawings, wherein FIG. 1 presents a side view of an elevator car, which is provided with one safety device arrangement according to the invention, for preventing unintended movement of the elevator car, FIG. 2 presents the elevator car according to FIG. 1 as viewed from the direction of the rear wall of the elevator car, FIG. 3 presents a side view of an elevator car, which is provided with another safety device arrangement according to the invention, for preventing unintended movement of the elevator car, FIG. 4 presents the elevator car according to FIG. 3 as viewed from the direction of the rear wall of the elevator car, FIG. 5 presents a side view of an elevator car, which is provided with yet another safety device arrangement according to the invention, for preventing unintended movement of the elevator car, in a situation in which no-one is on the roof of the elevator car, FIG. 6 presents a detail, as viewed from the side of the elevator car, of the bottom end of the lever system of the safety device arrangement according to FIG. 5 in a situation in which a person is on the roof of the elevator car, and FIG. 7 presents a detail, as viewed from the side of the elevator car, of the bottom end of the lever system of the safety device arrangement according to FIG. 5 in a situation in which an unintended movement upwards has stopped.

FIGS. 1 and 2 present a simplified view of one type of safety device arrangement according to the invention for preventing unintended movement of the elevator car 1 and at the same time for creating the upper safety space needed in the elevator hoistway. The safety device arrangement of FIG. 1 is presented as viewed from the side of the elevator car 1, and in FIG. 2 as viewed from the direction of the rear wall of the elevator car 1. For the sake of clarity, the guide rails of the elevator car 1 are not presented in FIG. 1.

The elevator car 1 can be a conventional elevator car provided with a car door 2, said elevator car having the rope 6 of the overspeed governor connected to the wedges 3*a* of a bidirectional safety gear functioning as a safety brake device 3 to stop unintended movement of the elevator car 1. On both sides of the elevator car 1 is one safety gear functioning as a safety brake device 3, which are connected to each other via a synchronization lever 3*b*, in which case the wedges 3*a* of both safety gears act in the same way and at the same time.

FIGS. 1 and 2 present only a part of the overspeed governor of the elevator car, i.e. the rope pulley 5*a* of the overspeed governor in the top end of the hoistway and the diverting pulley 5*b* in the bottom end of the hoistway, as well as the rope 6 of the overspeed governor, the first part of which rope is connected to the wedges 3*a* of the bidirectional safety gear functioning as the safety brake device 3 of the elevator car and is marked with the reference number 6*a*, and the second part of which rope is connected to the lever apparatus 9 functioning as a transmission means of the safety device arrangement and is marked with the reference number 6*b*.

The safety device arrangement of an elevator, said arrangement being according to the invention, comprises a tuning apparatus 4, for displacing the wedges 3*a* of the safety brake device 3, i.e. for example a safety gear, into such a position that the wedges 3*a* compress the elevator guide rail 11 that is between the wedges 3*a* of the safety gear with a force that prevents unintended movement of the elevator car 1, in this case upwards.

The tuning apparatus comprises at least a plate-like or meshed plate type tread base 7 arranged movably in the vertical direction on vertical guide rails 7*a*, which tread base is disposed immediately above the roof of the elevator car 1 and to rest supported on spring means 7*b*, as well as to cover essentially the whole of the roof of the elevator car 1 in such a way that when stepping onto the roof a person must always go on top of the tread base 7. Between the top surface of the roof of the elevator car 1 and the bottom surface of the tread base 7 is an air gap 7*c* for enabling vertical movement of the tread base 7. Additionally, between the top surface of the roof of the elevator car 1 and the bottom surface of the tread base 7 is a supervision contact 8 belonging to the tuning apparatus 4 and functioning as a movement detector of the tread base 7, which supervision contact is arranged to detect vertical movement of the tread base 7 and to disconnect the safety circuit of the elevator when the tread base 7 moves downwards, in which case the elevator cannot be driven. The roller of the supervision contact 8 leans from below on the bottom surface of the tread base 7 and moves the lever of the supervision contact 8 up and down when the tread base 7 moves up and down.

The tuning apparatus 4 also comprises a lever apparatus 9 functioning as a transmission means, in which is e.g. a ram part 9*a*, a lever part 9*b* and a hinge 9*c* in the lever part 9*b*, by means of which hinge the lever part 9*b* is hinged to the elevator car 1, and the location of which hinge 9*c* in relation to the ends of the lever part 9*b* is arranged to determine the lever ratio and at the same time the movement distance of the ends of the lever part 9*b*. The lever part 9*b* of the lever apparatus 9 is connected at its first end to the tread base 7 via the ram part 9*a* and at its second end to the second part 6*b* of the rope 6 of the overspeed governor. The lever part 9*b* of the lever apparatus 9 is hinged by means of the hinge 9*c* to the elevator car 1 in such a way that when the tread base 7 is pressed downwards after a person has stepped onto the tread base 7, the lever apparatus 9 pulls, by means of the second end of the lever part 9*b*, the second part 6*b* of the rope 6 of the overspeed governor upwards by a distance determined by the lever ratio, in which case at the same time the first part 6*a* of the rope 6 of the overspeed governor moves the same amount downwards and displaces the wedges 3*a* of the safety gear to compress the guide rail 11. In this case the elevator car 1 is locked into its position by means of the bidirectional safety gear functioning as the safety brake device 3 and in this way a sufficiently large top safety space is formed enabling working in the hoistway.

The elevator safety device arrangement according to the invention also comprises a bypass apparatus 10 for the locking of the elevator car 1, by using which the locking of the elevator car 1 implemented with the wedges 3*a* of the safety gear can be temporarily removed, e.g. for performing a service drive. The locking-bypass apparatus 10 comprises at least a lever arrangement, comprising e.g. a ram part 10*a*, a lever part 10*b* and a hinge 10*c* in the lever part 10*b*, by means of which hinge the lever part 10*b* is hinged to the elevator car 1, and the location of which hinge 10*c* in relation to the ends of the lever part 10*b* is arranged to determine the lever ratio and at the same time the movement distance of the ends of the lever part 10*b*. At the top end of the ram part 10*a* is e.g. a pedal extending to above the top surface of the tread base 7, said pedal to be pressed by foot or by hand. The lever part 10*b* of the bypass apparatus 10 is connected at its first end to the bottom end of the ram part 10*a* and at its second end e.g. to the wedges 3*a* of the safety gear functioning as a safety brake device 3 in such a way that when pressing the pedal of the ram part 10*a* and keeping the ram part 10*a* activated, i.e. pressed downwards, the locking-bypass apparatus 10 detaches and keeps the safety gear wedges 3*a* off the elevator guide rails 11, in which case the elevator car 1 can be driven e.g. on service drive.

FIGS. 3 and 4 present a simplified view of a safety device arrangement, according to a second embodiment of the invention, for preventing unintended movement of the elevator car 1 and at the same time for creating the upper safety space needed in the elevator hoistway. The safety device arrangement in FIG. 3 is presented as viewed from the side of the elevator car 1, and in FIG. 4 as viewed from the direction of the rear wall of the elevator car 1. The safety device arrangement according to FIGS. 3 and 4 differs from the safety device arrangement according to FIGS. 1 and 2 only in that the lever apparatus 9 and the locking-bypass apparatus 10 are different to those in the safety device arrangement according to FIGS. 1 and 2. In the solution according to FIGS. 3 and 4 the lever apparatus 9 is arranged to act directly on the movement of the wedges 3*a* of the safety gear without the transmission of the rope 6 of the overspeed governor. The lever apparatus 9 can in this case be composed of just a ram part 9*a*, as is presented in FIGS. 3 and 4, or the lever apparatus 9 can have a lever transmission changing transmission ratio and travel distances. In this case the transmission is direct, in which case the ram part 9*a* is e.g. a rod, which is connected directly to the wedges 3*a* of the safety gear functioning as a safety brake device 3 in such a way that when the tread base 7 moves a certain distance downwards or upwards the wedges 3*a* move the same distance downwards or upwards. The ram part 9*a* is in this case connected at its first end to the tread base 7 to move along with the vertical movement of the tread base 7, and at its second end to the wedges 3*a* of the safety gear.

Correspondingly, the lever arrangement of the locking-bypass apparatus 10 is now, owing to the embodiment, arranged to act on the ram part 9*a* of the lever apparatus 9 for locking and not directly on the wedges 3*a* of the safety gear, although that solution also would be fully possible. When the ram part 10*a* of the locking-bypass apparatus 10 is pressed and held pressed down, the lever part 10*b* turns around its hinge 10*c* that is hinged to the elevator car 1 and the second end of the lever part 10*b* connected to the ram part 9*a* of the lever apparatus 9 for locking rises upwards at the same time pulling the wedges 3*a* away from the elevator guide rails, in which case the elevator car 1 can be driven e.g. on service drive.

Additionally, in the top part of the hoistway is a safety shoulder fixed to a wall or to a guide rail, which shoulder eliminates the effect of the bypass apparatus 10 or prevents the use of the bypass apparatus 10 when the elevator car 1 is so high that the top safety space would be too shallow. In this case the elevator car 1 locks into its position and will no longer rise higher.

The tuning apparatus 4 is arranged to return automatically to normal drive mode after people have left the roof of the elevator car 1 and got off the tread base 7. In this case separate electrical supervision circuits differing from normal are not needed.

FIGS. 5-7 present a simplified view of a safety device arrangement, according to a third embodiment of the invention, for preventing unintended movement of the elevator car 1 and at the same time for creating the upper safety space needed in the elevator hoistway. FIG. 5 presents a situation in which no-one is on the roof of the elevator car, in which case the tread base 7 is in its upper position and the safety gear wedges 3*a* are detached from the elevator guide rails 11, so the elevator car 1 can move freely.

Correspondingly, FIG. 6 presents a situation in which on the roof of the elevator car 1 is a person who has stepped onto the tread base 7 and the tread base 7 has been pressed downwards and has also tripped the safety arrangement in such a way that the safety gear wedges 3*a* are detached from the elevator guide rails 11, so the elevator car 1 can be driven upwards up until a safe height.

FIG. 7 presents a situation in which on the roof of the elevator car 1 is a person who has stepped onto the tread base 7 and the elevator car 1 has been driven so far upwards that it has stopped at the bottom limit of the top safety space.

The solution according to FIGS. 5-7 differs from the solutions according to FIGS. 1-4 e.g. in that the lever apparatus 9 for locking, said apparatus functioning as a transmission means, is arranged to pull the wedges 3*a* of the safety gear against the guide rails 11 only when the elevator car 1 has risen to be so high that the lever part 9*b* of the lever apparatus 9 has hit the rigid detent 12 that is in the elevator hoistway. The detent 12 is disposed in a fixed manner in the elevator hoistway at such a height that a sufficiently high top safety space forms in the top end of the elevator hoistway, into which top safety space the elevator car 1 is not able to ascend when people are on the roof of the elevator car, even though the elevator car 1 in normal drive would be able to ascend higher when driving to the landing of the topmost floor.

The tuning apparatus 4 in this solution comprises a lever apparatus 9, in which is e.g. a ram part 9*a*, a lever part 9*b* and a hinge 9*c* at the first end of the lever part 9*b*, by means of which hinge the lever part 9*b* is hinged to the elevator car 1. At the second end of the lever part 9*b* is a roller 9*d*, which is arranged to hit the detent 12 that is disposed in a fixed manner in the hoistway for stopping unintended upward movement of the elevator car and at the same time for creating the upper safety space needed in the elevator hoistway.

The ram part 9*a* is connected at its top end to the tread base 7 to move downwards and upwards along with the tread base 7, and at its bottom end to the lever part 9*b*, to the location between the first end and second end of the lever part 9*b* to give the desired lever ratio. The lever apparatus 9 is dimensioned in such a way that in normal operation of the elevator the lever part 9*b* is turned away from the front of the detent, e.g. into its upper position as presented in FIG. 5, in which case the lever arm 9*b* also does not press the wedges 3*a* of the safety gear downwards because the lever arm does not hit the ram detent 13 of the wedges 3*a* of the safety gear. In this case the elevator can be driven normally.

FIG. 6 presents a situation in which a person goes onto the roof of the elevator car 1 and steps onto the tread base 7, in which case the tread base 7 is pressed downwards against the spring means 7*b* and at the same time the ram part 9*a* presses downwards, pressing also the lever part 9*b* to turn downwards around the hinge 9*c*, until the bottom surface of the lever part 9*b* is against, or almost against, the ram detent 13 of the wedges 3*a* of the safety gear, and the roller 9*d* on the second end of the lever part 9*b* has turned into its outermost position so far that the roller 9*d* would hit the detent 12 if the elevator car 1 were at the height of the detent 12. When the tread base 7 has been pressed downwards, the supervision contact 8 has disconnected the safety circuit of an elevator, but in this state the elevator can still be driven on service drive as long as the elevator car 1 is below the detent 12. In this case a separate bypass apparatus 10 according to FIGS. 1-4 is not needed in the safety arrangement.

FIG. 7 presents a situation in which at least one person is on the roof of the elevator car 1 and the elevator car 1 has been driven to the bottom limit of the top safety space. In this case the roller 9*d* of the lever part 9*b* of the lever apparatus 9 has lowered to its bottom position and has hit the detent 12, which has pressed the second end of the lever part 9*b* downwards so much that the bottom surface of the lever part 9*b* has at the same time pressed the wedges 3*a* of the safety gear downwards and against the guide rails of the elevator car, in which case the movement of the elevator car 1 has stopped and a sufficiently high top safety space has remained in the top end of the elevator hoistway.

When the person has left the roof of the elevator car 1, the lever apparatus 9 is arranged to be returned to normal drive mode either manually or automatically. In the manually returnable solution, the return lever is disposed e.g. on the overhead beam of the car door, in which case it is always easily reachable from a landing.

What is common to the solutions of all the embodiments of the invention is, inter alia, that in the safety device arrangement is a tuning apparatus 4 disposed on the roof of the elevator car 1, by means of which tuning apparatus the presence of people on the roof is detected and a sufficient top safety space is created for working in the elevator hoistway. The top safety space is created by acting e.g. on the wedges 3*a* of the safety gear functioning as a safety brake device 3 of the elevator in such a way that the safety gear is brought into standby mode or is activated by displacing the wedges 3*a* of the safety gear to compress the guide rails 11 of the elevator car 1 when at least one person goes onto the roof of the elevator car 1. Bringing the safety gear into standby mode or activation can be performed mechanically, e.g. with lever apparatuses, such as in the embodiments described above, or also electrically.

It is obvious to the person skilled in the art that different embodiments of the invention are not only limited to the examples described above, but that they may be varied within the scope of the claims presented below. Thus, for example, instead of a mechanical tuning apparatus, the tuning apparatus can be partly optical, e.g. a light curtain, connected to electrical actuators.

It is also obvious to the skilled person that the mechanical lever apparatuses presented are just simple examples and they can be constructed also in other ways.

It is also obvious to the person skilled in the art that the safety brake device of an elevator presented above can be some other brake device gripping to the guide rails of the elevator car than the normal safety gear of the elevator.

It is likewise obvious to the skilled person that the solution according to the invention can just as well be applied also to stopping the unintended downward-directed movement of an elevator car.

The invention claimed is:

1. An elevator, comprising:

an elevator car configured to travel along one or more guide rails within an elevator hoistway; and a safety brake device configured to selectively inhibit movement of the elevator car, wherein the safety brake device includes, a tread base on a roof of the elevator car, the tread base configured to move in a vertical direction, a detector configured to detect vertical movement of the tread base in relation to the roof of the elevator car, one or more wedges configured to be displaced against the one or more guide rails of the elevator car to lock the elevator car into position, and a mechanical lever apparatus connected to the tread base, the mechanical lever apparatus configured to cause the one or more wedges to be displaced against the one or more guide rails based on detection of vertical movement of the tread base in relation to the roof of the elevator car.

2. The elevator according to claim 1, wherein the tread base is configured to move on one or more vertical guide rails above the roof of the elevator car, and rest on a spring.

3. The elevator according to claim 1, wherein, the detector includes a supervision contact between the roof of the elevator car and the tread base, the supervision contact configured to detect vertical movement of the tread base in relation to the roof of the elevator car, and disconnect a safety circuit of the elevator based on a determination that the tread base has moved downwards in relation to the roof of the elevator car.

4. The elevator according to claim 1, wherein, the mechanical lever apparatus is connected at a first end of the mechanical lever apparatus to the tread base and at a second end of the mechanical lever apparatus to a rope of an overspeed governor, such that the mechanical lever apparatus is configured to cause the overspeed governor to displace the one or more wedges of the safety device brake, based on the tread base moving downwards in relation to the roof of the elevator car.

5. The elevator according to claim 1, wherein, the mechanical lever apparatus is connected at a first end of the mechanical lever apparatus to the tread base and at a second end of the mechanical lever apparatus directly to the one or more wedges of the safety device brake, such that the mechanical lever apparatus is configured to displace the one or more wedges against the one or more guide rails of the elevator car, based on the tread base moving downwards in relation to the roof of the elevator car.

6. The elevator according to claim 1, wherein, the mechanical lever apparatus includes a ram part, the ram part being connected at a first end of the ram part to the tread base, the ram part including a lever part at a second end of the ram part, the lever part being hinged to the elevator car at a first end of the lever part, the lever part including a roller at a second end of the lever part, the roller configured to displace the one or more wedges against the one or more guide rails of the elevator car, based on contacting a rigid detent in a top portion of the elevator hoistway.

7. The elevator according to claim 6, wherein the lever part is configured to turn, pulled by the ram part, into a particular position such that the roller is isolated from contact with the rigid detent when the elevator car is driving past the rigid detent, based on the tread base being in an upper position in relation to the roof of the elevator car.

8. The elevator according to claim 1, wherein, the safety brake device includes a bypass apparatus, the bypass apparatus includes a ram part, the bypass apparatus is connected to a rope of an overspeed governor, and the bypass apparatus is configured to temporarily disable locking of the elevator car.

9. The elevator according to claim 1, wherein, the mechanical lever apparatus is connected to the tread base, such that the mechanical lever apparatus is configured to transmit movement of the tread base in relation to the roof of the elevator car to a rope of an overspeed governor to cause the overspeed governor to displace the one or more wedges against the one or more guide rails to lock the elevator car into position, based on the tread base moving downwards in relation to the roof of the elevator car.

10. The elevator according to claim 1, wherein, the mechanical lever apparatus connected to the tread base, such that the mechanical lever apparatus is configured to transmit movement of the tread base in relation to the roof of the elevator car to the one or more wedges of the safety device brake to displace the one or more wedges against the one or more guide rails of the elevator car, based on the tread base moving downwards in relation to the roof of the elevator car.

11. The elevator according to claim 1, wherein the safety brake device is a bidirectional safety gear apparatus that includes one or more wedges.

12. The elevator according to claim 1, wherein the elevator car is supported with one or more hoisting ropes from a bottom part of the elevator car.

13. The elevator according to claim 1, wherein the elevator car is supported from a bottom part of the elevator car with one or more hoisting ropes, the one or more hoisting ropes being conducted via one or more diverting pulleys, respectively.

14. A safety brake device for an elevator car, the elevator car configured to travel along one or more guide rails within an elevator hoistway, the safety brake device comprising:

a tread base on a top surface of a roof of the elevator car, the tread base configured to move in a vertical direction;

a detector configured to detect vertical movement of the tread base in relation to the roof of the elevator car;

one or more wedges configured to be displaced against the one or more guide rails of the elevator car to lock the elevator car into position; and a mechanical lever apparatus connected to the tread base, the mechanical lever apparatus configured to cause the one or more wedges to be displaced against the one or more guide rails based on detection of vertical movement of the tread base in relation to the roof of the elevator car.

15. The safety brake device according to claim 14, wherein, the mechanical lever apparatus is connected at a first end of the mechanical lever apparatus to the tread base and at a second end of the mechanical lever apparatus to a rope of an overspeed governor, such that the mechanical lever apparatus is configured to cause the overspeed governor to displace the one or more wedges, based on the tread base moving downwards in relation to the roof of the elevator car.

16. The safety brake device according to claim 14, wherein, the mechanical lever apparatus is connected at a first end of the mechanical lever apparatus to the tread base and at a second end of the mechanical lever apparatus directly to the one or more wedges, such that the mechanical lever apparatus is configured to displace the one or more wedges against the one or more guide rails of the elevator car, based on the tread base moving downwards in relation to the roof of the elevator car.

17. The safety brake device according to claim 14, wherein, the mechanical lever apparatus includes a ram part, the ram part being connected at a first end of the ram part to the tread base, the ram part including a lever part at a second end of the ram part, the lever part being hinged to the elevator car at a first end of the lever part, the lever part including a roller at a second end of the lever part, the roller configured to displace the one or more wedges against the one or more guide rails of the elevator car, based on contacting a rigid detent in a top portion of the elevator hoistway.

18. The safety brake device according to claim 14, wherein, the safety brake device includes a bypass apparatus, the bypass apparatus includes a ram part, the bypass apparatus is connected to a rope of an overspeed governor, and the bypass apparatus is configured to temporarily disable locking of the elevator car.

19. The safety brake device according to claim 14, wherein, the mechanical lever apparatus is configured to transmit movement of the tread base in relation to the roof of the elevator car to a rope of an overspeed governor to cause the overspeed governor to displace the one or more wedges against the one or more guide rails to lock the elevator car into position, based on the tread base moving downwards in relation to the roof of the elevator car.

20. The safety brake device according to claim 14, wherein, the mechanical lever apparatus is configured to transmit movement of the tread base in relation to the roof of the elevator car to the one or more wedges to displace the one or more wedges against the one or more guide rails of the elevator car, based on the tread base moving downwards in relation to the roof of the elevator car.

* * * * *